US006644521B1

(12) United States Patent
Tiss et al.

(10) Patent No.: US 6,644,521 B1
(45) Date of Patent: Nov. 11, 2003

(54) SHOULDER SUPPORT FOR GARMENTS

(75) Inventors: Irving Tiss, Springfield, NJ (US); Burton J. Schwartz, Livingston, NJ (US)

(73) Assignee: Des-L Industries, Inc., Irvington, NJ (US)

( * ) Notice: Subject to any disclaimer, the term of this patent is extended or adjusted under 35 U.S.C. 154(b) by 0 days.

(21) Appl. No.: 09/904,338

(22) Filed: Jul. 12, 2001

(51) Int. Cl.[7] ..... A41D 27/22
(52) U.S. Cl. ..... 223/98; 223/87
(58) Field of Search ..... 223/89, 87, 85, 223/98

(56) References Cited

U.S. PATENT DOCUMENTS

| | | | | |
|---|---|---|---|---|
| 2,160,947 A | | 6/1939 | Reinhardt | 260/80 |
| 2,353,839 A | | 7/1944 | McFall | 223/98 |
| 2,581,631 A | * | 1/1952 | Carta | 223/88 |
| 2,597,509 A | | 5/1952 | Mallory | 223/88 |
| 2,601,442 A | | 6/1952 | Mallory | 223/88 |
| 2,675,948 A | | 4/1954 | Mallory | 223/98 |
| 2,841,316 A | | 7/1958 | Johnson | 223/98 |
| 3,124,284 A | | 3/1964 | Collum | 223/98 |
| 3,153,499 A | * | 10/1964 | Babiskin et al. | 223/88 |
| 3,294,296 A | | 12/1966 | Gelman | 223/98 |
| 3,428,229 A | | 2/1969 | Tiss | 223/87 |
| 3,847,314 A | * | 11/1974 | Florian | 223/98 |
| 4,026,447 A | * | 5/1977 | Wnek | 223/98 |
| 4,658,997 A | | 4/1987 | Nash | 223/98 |
| 4,944,436 A | | 7/1990 | Moen | 223/98 |

FOREIGN PATENT DOCUMENTS

EP 0 576 884 B1 6/1993

* cited by examiner

*Primary Examiner*—John J. Calvert
*Assistant Examiner*—James G. Smith
(74) *Attorney, Agent, or Firm*—Lerner, David, Littenberg, Krumholz & Mentlik, LLP

(57) ABSTRACT

A shoulder support for garments hung on a wire hanger is a generally unitary member made of a resilient material. The shoulder support has a center section and a pair of spaced shoulder sections connected at one end to the center section and extending in opposite directions. The center section has a front wall and a back wall disposed in spaced relation to define an opening. A releasable locking connector assembly is formed on the front wall for operative connection to the wire hanger for the garment. The shoulder support can be constructed from rigid plastic material, or optionally, flexible plastic material which will allow the shoulder support to narrow, squeeze or collapse when subjected to compressive forces during the storage or stacking of the garments assembled on the hanger, and when the compressive forces are removed, will expand to its original shape for protecting the garment from distortion and creasing.

26 Claims, 4 Drawing Sheets

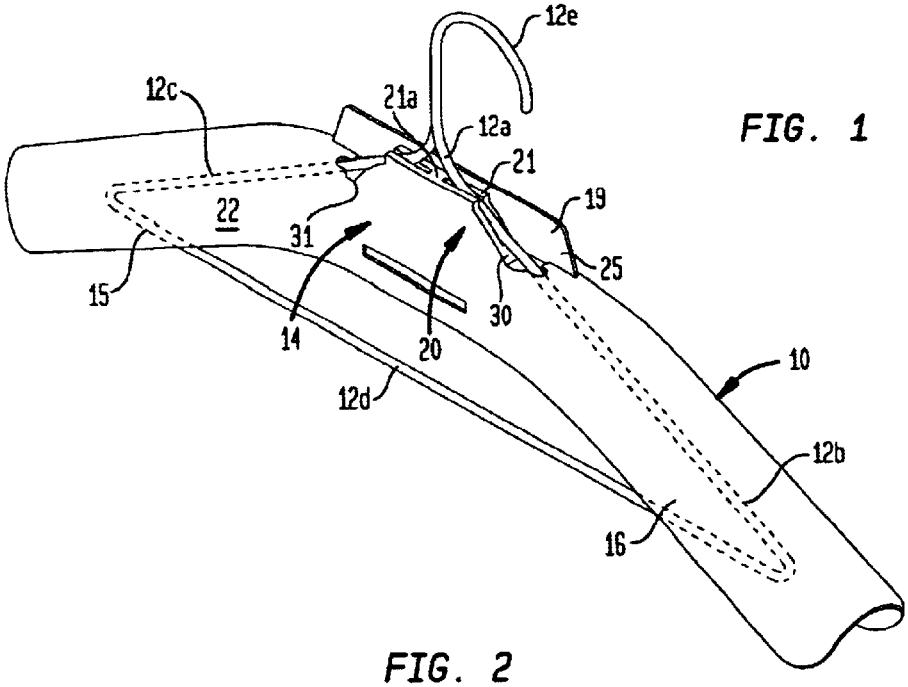
FIG. 1
FIG. 2
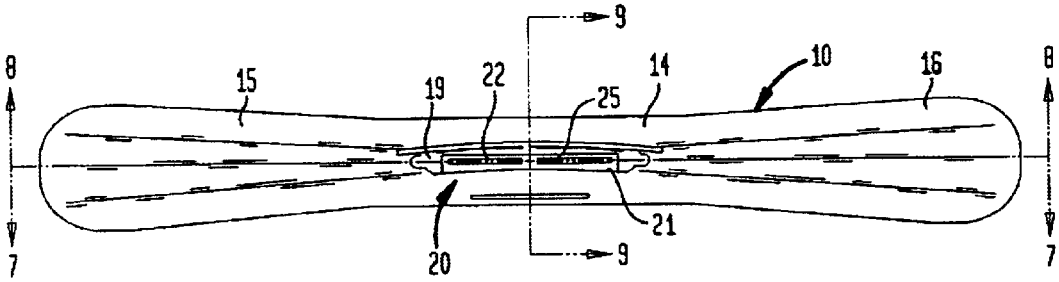
FIG. 3
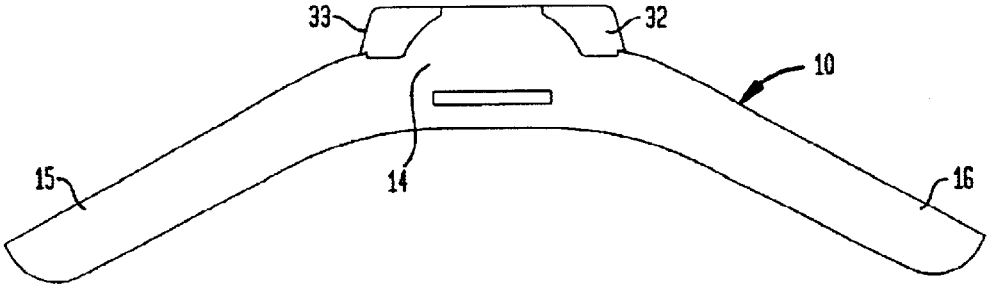

SHOULDER SUPPORT FOR GARMENTS

FIELD OF THE INVENTION

This invention relates generally to attachments for retaining the shape of the shoulders of a garment, and more particularly, to a generally unitary, preferably plastic, shoulder support for use with garments stored on a wire hanger for retaining the shape of the shoulders and/or collars on such garments and to protect the garments from being distorted and creased when the garment is stored for more or less periods of time.

BACKGROUND OF THE INVENTION

It is well known, particularly in the cleaning industry, that certain types of garments having either or both shoulders and collars, when stored on wire hangers for more or less protracted periods of time, tend to become misshapen, distorted and/or creased at either the shoulder and/or the collar sections. Various types of attachments for operative association with the wire hangers and such garments have been developed to overcome these problems, as is shown in U.S. Pat. Nos. 2,353,839; 3,428,229; 2,597,509; 2,841,316; 3,294,296; 2,601,442; 2,675,948; 4,658,997 and 4,944,436. These attachments are disclosed as being constructed from a variety of materials, for example, rigid plastic and cardboard like materials.

For example, in U.S. Pat. No. 2,675,948, a generally unitary hanger attachment which may be made of plastic material is shown and described in combination with a wire hanger. The attachment has a center section with a back wall opposing an open front and spaced apart shoulder shaped sections. The shoulder shaped sections are connected at one end to the center section and extend in opposite directions so that the center section and the shoulder shaped sections forming the attachment can be easily mounted over the wire hanger. The back wall of the center section has spaced vertically disposed ribs with transverse notches so that the attachment can be removably connected to the wire hanger by means of engagement of the horizontal portion of the wire hanger within the notches on the ribs.

U.S. Pat. No. 3,428,229 discloses a shoulder guard constructed from a flat blank of stiff cardboard like material. The shoulder guard includes a front panel, two flaps at the upper portion of the panel and a collar spreader between the flaps across the top of the vertical center line of the panel. The flaps are adapted to be folded down along the fold lines that divert outwardly and downwardly from the ends of the collar spreader. The fold lines form a halfconical portion at each side of the panel, sloping downwardly and adapted to rest on the shoulder supports of a wire hanger to provide wider curved shoulder supports for a garment. The central part of the collar spreader is provided with an aperture through which the hook portion of the wire hanger is received for positioning the shoulder guard on the wire hanger.

U.S. Pat. Nos. 2,601,442 and 2,597,509 each disclose individual shoulder supports which may be releasably attached to the sloping portion of a wire hanger for supporting the shoulder portion of a garment. For example, the '509 Patent discloses the shoulder supports being constructed from thin metal or plastic like material including a pair of arms which may be displaced from the shoulder support for capturing therebetween the horizontal portion of the wire hanger. In the '442 Patent, the shoulder support is constructed of similar materials, and includes a pair of spaced apart depending wire brackets which are operative for engaging the sloping and horizontal portions of the wire hanger.

U.S. Pat. No. 4,658,997 discloses a shoulder guard of plastic material for support over a wire hanger. The shoulder guard includes a neck portion having a substantially planar upper surface which is provided with a hook passage slot. The slot includes first and second portions shaped to respectively pass and selectively retain the neck portion of a wire hanger thereby permitting angular adjustment of clothes on the hanger. For stabilizing the shoulder guard, the neck portion is provided with a third slot communicating with the second slot and disposed substantially parallel to the first slot, thereby permitting at least a portion of the neck of the wire hanger to extend through the third slot for securing and stabilizing the shoulder guard on the wire hanger.

From the foregoing, there is known a variety of shoulder guards constructed for attachment by various means to a wire hanger for supporting a garment thereon. These designs have a number of disadvantages such as in manufacturing costs, ease of assembly and use, reliability upon securement to a wire hanger, degree of garment support and/or complexity in manufacture. Accordingly, there is the need for improvements in a shoulder support for use with garments stored on a wire hanger for retaining the shape of the shoulders and/or collars on the garments.

SUMMARY OF THE INVENTION

The present invention overcomes the aforesaid problems attributable to known shoulder supports by providing a shoulder support of economical design and manufacture for garments which is detachably connectable to a wire hanger. The shoulder support can be fabricated or molded as a generally unitary or integral member of a relatively firm but resilient, preferably plastic material. However, it is contemplated that stiff cardboard-like material can also be used to construct the shoulder support in accordance with the present invention. The plastic member, by virtue of its designed resiliency, will narrow, squeeze or collapse under compressive forces which occur when garments are stored or stacked and thus reduce the space occupied by the garments and, on release of these compressive forces, expand back to substantially the original shape of the shoulder support to continue protecting the shoulders of the garment from distortion and creases. This feature of the shoulder support of the present invention is particularly useful at dry cleaning establishments where hundreds of garments are hung on a rack prior to being picked up by the customer. By enabling the shoulder supports to compress, a greater number of garments may be stored on a rack of fixed size, minimizing storage rack space and costs.

The shoulder support includes a center section and spaced oppositely extending shoulder supporting sections connected at one end to the center section and extending in opposite directions. The center section has a front wall and a back wall in spaced relation to each other to define an opening therebetween. Connector means is formed on the front wall of the center section for releasable locking engagement with a wire hanger, when the wire hanger is moved into assembled position on the shoulder support, after a portion of the hanger is extended through the opening formed in the center section. A collar shaper member may also be provided and formed on the back wall for engagement with garments which have collar sections thereon.

Additionally, the shoulder support for garments as above described can be provided with one or more slots on the front wall and/or the back wall for ties, belts and other accessories associated with the garment hung on the shoulder support.

Accordingly, in one aspect the present invention is directed to a shoulder support for garments, releasably connectable to a wire hanger. The shoulder support can be fabricated or molded as a generally unitary member made of a resilient material and having, a center section and spaced shoulder sections connected to the center section and extending in opposite directions. The center section has a front wall and a back wall disposed in spaced relation to define an opening therebetween, and connector means on the front wall disposed for releasable locking engagement with a wire hanger when a portion of the wire hanger is received through the opening.

It is another aspect of the present invention to provide a shoulder support for garments having collars and releasably connectable to a wire hanger. The shoulder support can be constructed as a generally unitary member made of a resilient material with a center section and spaced shoulder sections connected to the center section and extending in opposite directions. The center section has a front wall and a back wall disposed in spaced relation to define an opening therebetween, and a collar shaper member on the back wall disposed for releasable engagement with a collar member on a garment.

Another aspect of the present invention is directed to a shoulder support for garments having collars and connector means which are releasably connectable to a wire hanger. The shoulder support can be fabricated or molded as a generally unitary member made of a resilient material and having a center section and spaced shoulder sections connected to the center section and extending in opposite directions. The center section has a front wall and a back wall disposed in spaced relation to define an opening therebetween. Connector means are provided on the front wall disposed for releasable locking engagement with a wire hanger when a portion of the wire hanger is received through the opening. A collar shaper member on the back wall is disposed for releasable engagement with a collar member on a garment.

In a further aspect of the present invention, there is described an improved shoulder support for garments of the general type as above described in which the resilient material for the generally unitary member is plastic selected from the group of nylon, polyesters, polypropylenes, mixtures thereof and the like.

In a still further aspect of the present invention, there is described an improved shoulder support for garments of the general type as above described in which the resilient material for the generally unitary member is plastic having a predetermined gauge not less than about 0.005" so that the shoulder support will narrow, squeeze or collapse under compressive forces when the garment is stored or stacked, whereby the garment and the shoulder support will take up less space, and when the compressive forces are removed, the shoulder support will expand or spring back to substantially its original shape and continue to protect the garment from distortion and creasing.

Accordingly, it is an object of the present invention to provide a relatively simple and low-cost shoulder support for garments made of a resilient, preferably plastic, material which in assembled position during use can be narrowed, squeezed or collapsed when subjected to compressive forces when a garment is stored or stacked and, on release of the compressive forces, will expand or return substantially to its original shape for protecting the shoulders of the garment from distortion and creasing.

It is another object of the present invention to provide an improved shoulder support for garments which can be releasably locked onto a wire hanger for supporting the garment.

It is another object of the present invention to provide an improved shoulder support for garments having collars in which a collar shaper member is provided to preserve and protect the collar of the garment when the shoulder support is in assembled position.

DESCRIPTION OF THE DRAWINGS

Other objects and advantages of the invention, including the basic design and nature of the improvements thereon, will become apparent from the following description taken in conjunction with the accompanying drawings, in which:

FIG. 1 is a front perspective view of a shoulder support for garments in accordance with one embodiment of the present invention disposed in assembled position on a wire hanger, FIG. 2 is a top plan view of the shoulder support in FIG. 1 with a portion of the wire hanger in horizontal cross-section, FIG. 3 is a front elevational view of the shoulder support shown in FIG. 1 without the wire hanger.

DESCRIPTION OF THE PREFERRED EMBODIMENT

In describing the preferred embodiments of the subject matter illustrated and to be described with respect to the drawings, specific technology will be resorted to for the sake of clarity. However, the invention is not intended to be limited to the specific terms so selected. It needs to be understood that each specific term includes the technical equivalents which operate in a similar manner to accomplish a similar purpose and result.

Figure 4:
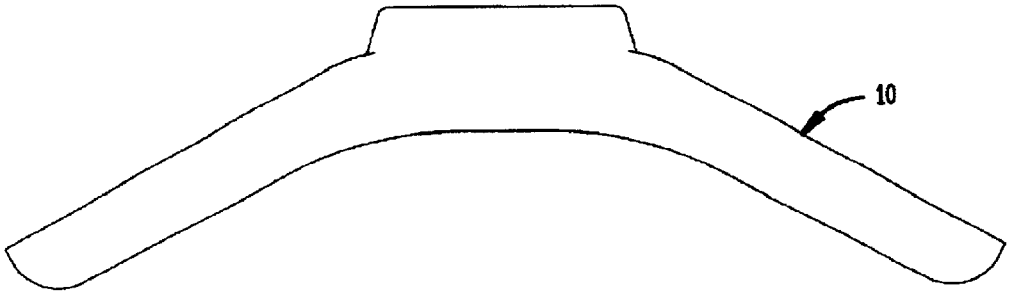
FIG. 4 is a back elevational view of the shoulder support shown in FIG. 3.
Figure 5:
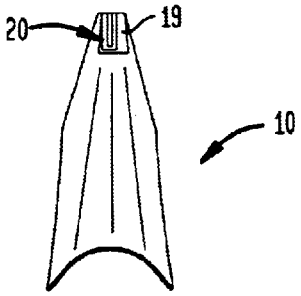
FIG. 5 is a right side view of the shoulder support shown in FIG. 3.
Figure 6:
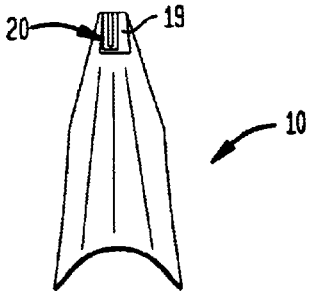
FIG. 6 is a left side view of the shoulder support shown in FIG. 3.
Figure 7:
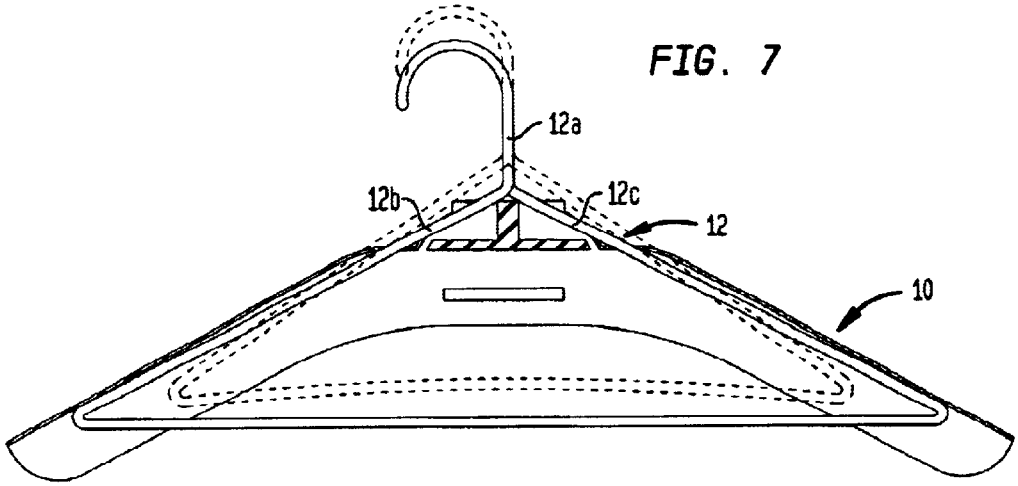
FIG. 7 is a longitudinal cross-section taken on line 7—7 of FIG. 2 with the wire hanger in dotted form in the intermediate non-engaged position and in sold lines in the assembled position.
Figure 8:
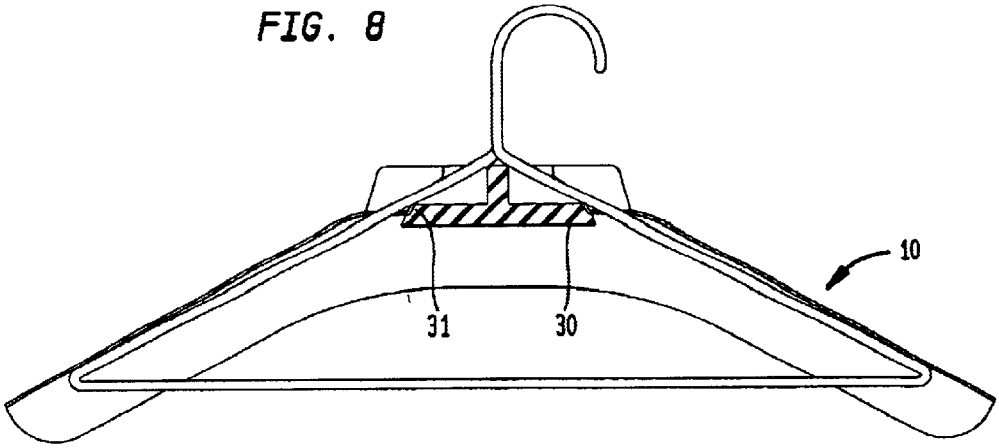
FIG. 8 is a longitudinal cross-section taken on line 8—8 of FIG. 2.
Figure 9:
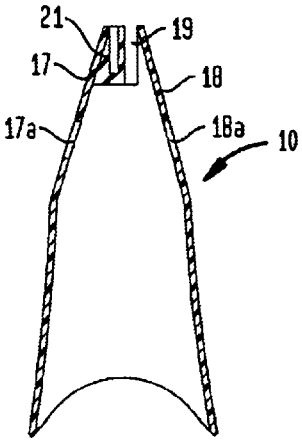
FIG. 9 is a vertical cross-section taken on line 9—9 of FIG. 2.
Figure 11:
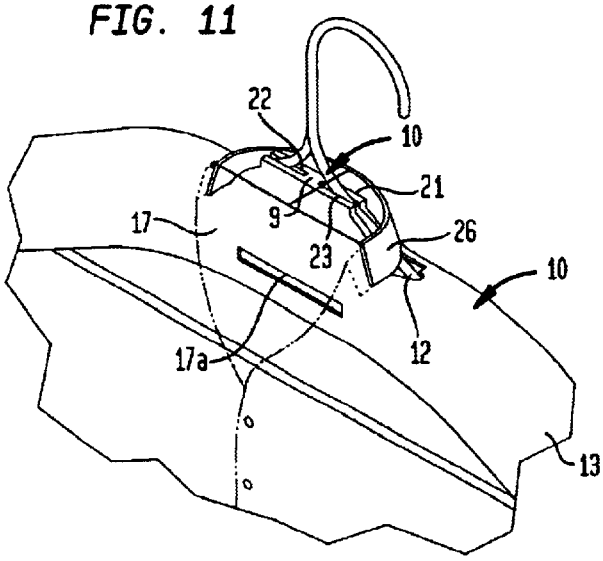
FIG. 11 is a partial perspective of the shoulder support in accordance with this embodiment of the invention disposed in assembled position on a wire hanger and showing the collar shaper in engagement with the collar on a garment shown in dotted lines.

Referring to the drawings wherein like reference numbers represent like elements, FIG. 1 shows a perspective view of a shoulder support in accordance with one embodiment of the present invention generally designated by reference number 10. The shoulder support 10 is illustrated in operative association with a hanger neck section 12*a* of a wire hanger 12 for supporting engagement with the shoulders of a garment 13 as shown in dotted form in FIG. 11. Wire hangers 12 for garments are well known and accordingly will not be more fully described. Briefly, the wire hanger 12 includes a pair of opposing sloped members 12*b* and 12*c* which connect to a horizontal member 12*d* in the form of a triangular shape. The sloped members 12*b* and 12*c* are joined by the neck section 12*a* from which there extends a hook 12*e*.

Shoulder support 10 is a preferably unitary member made of a resilient material such as plastic, for example, nylon, polyester, polypropylene, mixtures thereof and the like. The plastic material selected should have sufficient firmness or rigidity to support the shoulders of the garment and prevent them becoming distorted and creased. In addition, the plastic material selected should resist attack from the cleaning solvents which may be present on the garment after dry cleaning. The plastic selected can optionally be resilient enough to yield so that shoulder supports constructed therefrom can narrow, squeeze or collapse under compressive forces which are applied to the shoulder support when the garments are stored or stacked, and after the compressive forces are removed, to expand and return to their original shape. When plastic material having the noted characteristics is used for the shoulder support, the combined garment and shoulder support will thus take up a minimum amount of space when stored or stacked. This is particularly advantageous, for example, in cleaning establishments and other facilities where garments are stored for protracted periods of time.

As thus far described, a variety of plastic materials can be used for the shoulder support 10 constructed in accordance with the present invention. On the one hand, the plastic material can be of sufficient thickness to provide rigidity to support the shoulders of the garment and prevent them from becoming distorted and creased. As such, depending on the particular plastic used, its thickness can be determined to provide the requisite support. On the other hand, it optionally may be desired to provide the shoulder support 10 with resiliency to enable its compression as noted herein above. By way of example, the use of polypropylene and high density polyethylene material having a thickness of between 15–20 gauge is suitable in accordance with the present invention. By way of further example, the use of nylon, polyester or polypropylene materials having a thickness of at least 0.005" will provide sufficient rigidity to support the shoulders of the garment, while allowing for sufficient resiliency to be compressed yet returned to its normal state.

From the foregoing discussion, polymer materials having inherent characteristics of increased mechanical strength or rigidity may be used at thinner gauges than materials having less mechanical strength and rigidity. Thus, the particular thickness of the shoulder support 10 for a specified polymer will depend upon its, particular mechanical strength and rigidity. By way of further example, low density polyethylene material of about ¼ inch in thickness is contemplated as suitable for forming a rigid shoulder support 10. Thus, in view of the foregoing teachings, one skilled in the art of polymer materials would be able to select from a wide variety of plastic materials having various thicknesses which will be suitable for producing shoulder supports 10 in accordance the various aspects of the present invention.

forming the shoulder support 10 from plastic material, the shoulder support can be formed by molding, casting or other well-known techniques for shaping plastic material. In the preferred embodiment, the shoulder support will be integrally molded as one piece. However, it is contemplated that the shoulder support 10 can be formed as multiple pieces and assembled into a unitary shoulder support using suitable and well-known plastic forming techniques.

Figure 13:
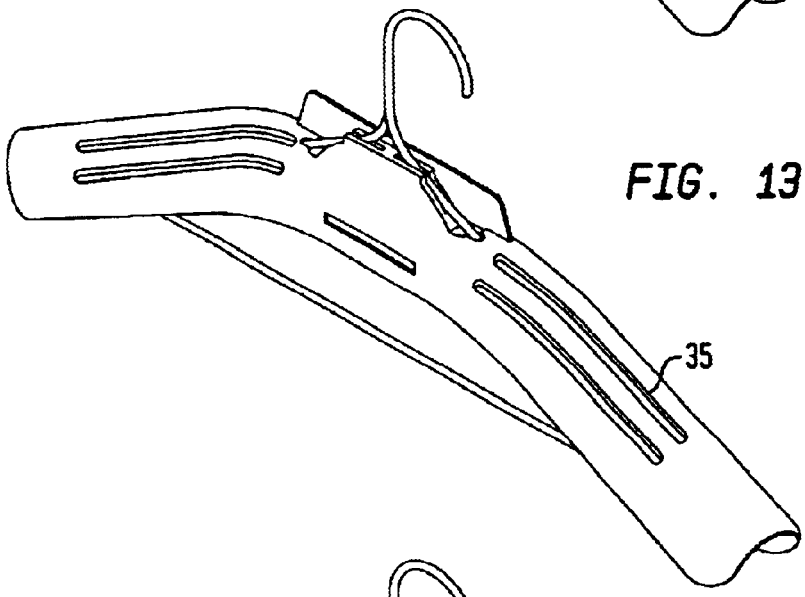
FIG. 13 shows a further embodiment of the shoulder support in accordance with the present invention having elongated depressions thereon to decrease the stiffness or rigidity of the shoulder support.
Figure 14:
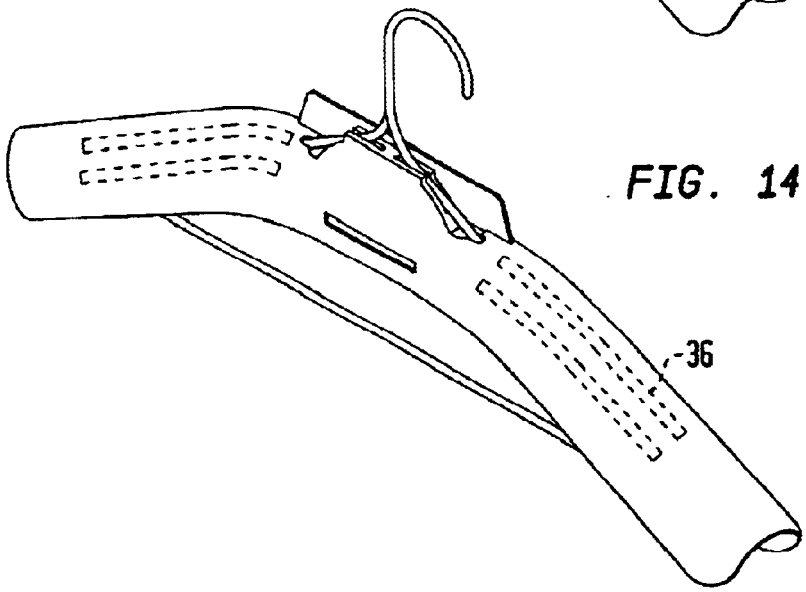
FIG. 14 is a still further embodiment of a shoulder support in accordance with the present invention in which elongated strips of the same or stiffer types of plastic materials or other materials such as metals may be affixed or adhered to the supporting sections of the shoulder support to increase stiffness or rigidity.

The shoulder support 10, as shown in FIGS. 1–9, has a center section 14 and a pair of spaced shoulder supporting sections 15, 16 which are connected at one end to the center section and extend therefrom in opposite directions. The spaced shoulder supporting sections 15, 16 may be disposed at an approximate angle about the same as the angle formed by the sloped members 12*a* and 12*b* of the operatively associated wire hanger 12. The shoulder supporting sections 15, 16 are generally formed as U-shaped members having an outer surface which may be provided with ribs or depressions to either increase or decrease the rigidity and/or flexibility of the shoulder supporting sections, as is shown in the further embodiments of the shoulder support at FIGS. 12 and 13 as hereinafter described. It is also contemplated that elongated strips of other materials, such as stiff metals and/or stiffer plastics in the nature of spines may be adhered to the surface of the shoulder supporting sections 15, 16 to increase rigidity at selected portions, as is also shown in FIG. 14 and hereinafter described.

Center section 14 has a front wall 17 and a back wall 18 which are disposed in spaced relation to each other to define an opening 19 therebetween through which the hanger neck section 12*a* and hook 12*e* can be inserted during assembly of the shoulder support 10 on the wire hanger 12, as is more fully described hereinafter. The front wall 17 and back wall 18 of the center section 14 are preferably unitarily formed as an integral member with the shoulder supporting sections 15, 16.

The center section 14 also has a connector assembly 20 formed thereon for releasably locking the hanger neck section 12*a* of the wire hanger 12 when it is assembled on the shoulder support 10. Connector assembly 20 has an inwardly extending arcuate shaped elongated plate or flat member 21 connected at one end to the upper end of the front wall 17. The connector assembly 20 is arranged overlying the opening 19 provided between the front wall 17 and back wall 18 of the center section 14. By way of example, the connector assembly 20 is arranged at a right angle to the front wall 17. While the plate or member 21 is described as arcuate or flat, those skilled in the art will recognize that this member can be angled or octagon or have other shapes without departing from the scope of the present invention.

Figure 10:
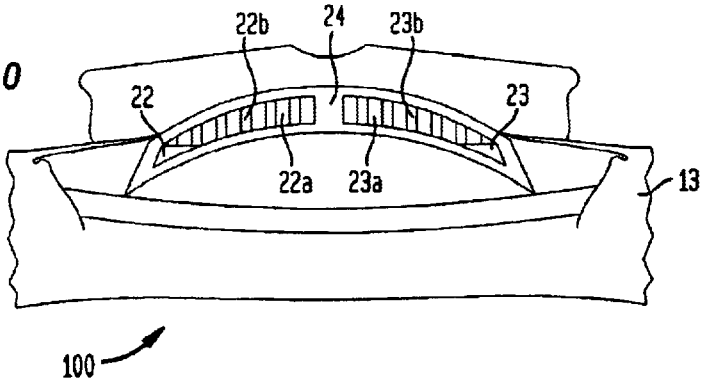
FIG. 10 is a fragmentary perspective view of the center section of the shoulder support shown in FIG. 2.

In order to establish the releasable locking engagement with the hanger neck section 12*a* of the wire hanger 12, the plate or member 21 is provided with spaced slots 22, 23 with optional serrated edges 22*a*, 22*b* for slot 22 and optional serrated edge 23*a*, 23*b* for slot 23 as shown in FIG. 10. The slots 22, 23 are separated by a support member 21*a* which functions to increase the strength or rigidity of the connector assembly 20 which is weakened by the presence of the slots. It is to be understood that the support member 21*a* may be omitted where the connector assembly 20 is provided with sufficient mechanical strength such that a single slot may be used. It is further to be understood that the connector assembly 20 may be attached extending from the back wall 18 so that the space will be provided between the connector assembly 20 and the front wall 17 to allow for the assembly of the wire hanger as will now be described.

The hanger neck section 12*a* is first moved upwardly through the opening 19 formed between the front wall 17 and back wall 18 so that it extends above the height of the connector assembly 20. At such time the slopping members 12*b* and 12*c* of the wire hanger 12 will be restrained by their engagement with the shoulder supporting members 15, 16. The neck section 12*a* is then brought forward so that the wire slopping members 12*b*, 12*c* forming the neck section 12*a* of the hanger 12 will be forced downwardly into the slots 22, 23 and optionally engage the respective serrated edges 22*a*, 22*b*, 23*a*, 23*b* of these spaced slots if provided. This is effected by the resilient force applied by the shoulder supported sections 15, 16 on the wire hanger 12 as noted. As a result, the neck section 12*a* will snap downwardly into the slots 22, 23. This prevents inadvertent removal of the shoulder support 10 once engaged with the wire hanger 12. The hanger 12 is precluded from passing through the slots 22, 23 by engagement of the slope members 12*b*, 12*c* with the respective ends 30, 31 of the connector assembly 20. As an additional support for the wire hanger 12, the support member 9 is formed on the plate or member 21 which can engage the lower end of the hanger neck section 12*a* when the neck section drops into engagement with the slots 22, 23 in the releasable connector assembly 20.

The front wall 17 and back wall 18 may be provided with slots 17*a*, 18*a* to hold ties or belts as may be desired in connection with the garment or in the display of the garment, as the case may be.

For garments with collars, a generally flat collar shaper 25 having sloped ends 32, 33, see FIG. 3 is formed extending upwardly on the back wall 18. When the shoulder support 10 is in assembled position on the wire hanger 12 and the garment 13 is hung thereon, the collar shaper 25 via its ends 32, 33 will engage with the collar on the garment to prevent it from becoming distorted or creased when the garment is being hung, stored or stacked. In accordance with the embodiment shown in FIG. 11, the collar shaper 26 may be in the form of an arcuate shaped member attached along a portion thereof to the back wall 18.

Figure 12:
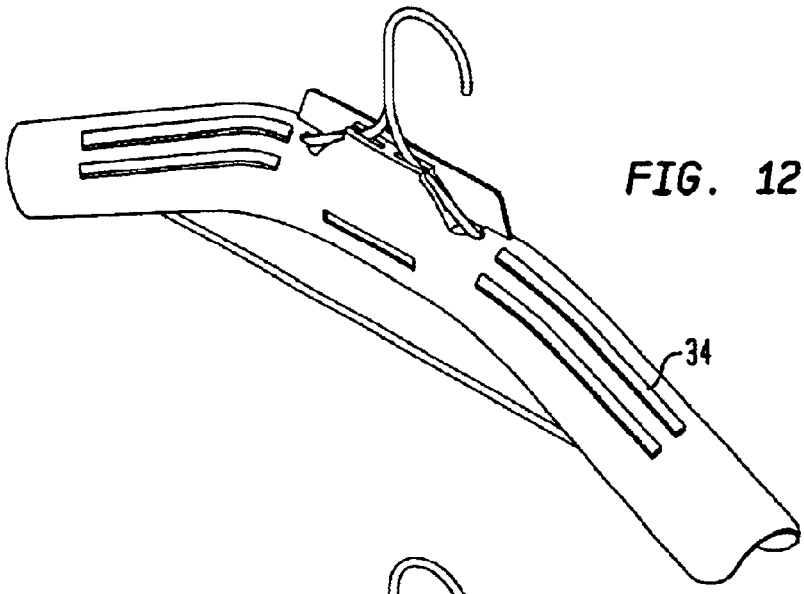
FIG. 12 shows another embodiment of the shoulder support in accordance with the present invention having ribs thereon to increase the stiffness or rigidity of the shoulder support.

It is also to be understood that the shoulder support 10 may be provided with ribs 34 as shown in FIG. 12 to increase the stiffness or rigidity of a more flexible polymer material, or where a thinner gauge material is used. Conversely, a plurality of elongated depressions 35 may be provided in the shoulder support 10 as shown in FIG. 13 so as to increase the flexibility of a more rigid or thicker polymer material.

As a still further means for increasing stiffness or rigidity, additional stiffening pieces as at 36 may be affixed to the underside of the shoulder support 10 as illustrated in FIG. 14 or, alternatively, to the surface of the shoulder support.

Accordingly, a relatively simple, low-cost improved shoulder support for garments for operative association with the wire hangers for such garments has been shown and described. It will be understood that the invention is not to be limited to the specific construction and arrangement of parts shown but that certain changes may be made in the disclosed embodiments and they may be widely modified without departing from the spirit and scope of the invention as defined by the claims as hereinafter set forth.

What is claimed is:

1. A shoulder support for garments releasably connectable to a wire hanger, said shoulder support comprising a generally unitary member having a front wall and a rear wall in spaced relation to each other to define an opening for receiving the wire hanger therethrough, said generally unitary member made of resilient plastic material from the group consisting of nylon, polyester, polypropylene and mixtures thereof having inherent mechanical strength and rigidity and of a gauge greater than about 0.005" such that under compressive forces, the shoulder support will be compressed from its original shape to occupy less space and on release of the compressive forces, the shoulder support will expand to substantially its original shape.

2. A shoulder support for garments attachable to a wire hanger, said shoulder support comprising a center section having a front wall and a rear wall in spaced relationship to each other to define an opening therebetween; a pair of shoulder supporting sections in spaced relationship and extending in opposite directions from said center section; and a connector means on said front wall for releasable locking engagement with a wire hanger after a portion of said wire hanger is received through said opening between said front wall and said rear wall and moved into engagement with said connector means.

3. A shoulder support for garments having a collar member attachable to a wire hanger, said shoulder support comprising a center section having a front wall and a rear wall in spaced relationship to each other to define an opening therebetween; a pair of shoulder supporting sections in spaced relation and extending in opposite directions from said center section; and a collar shaper means on said back wall for releasable engagement with the collar member on said garment when supported on said shoulder support.

4. A shoulder support for garments having a collar member attachable to a wire hanger, said shoulder support comprising a center section having a front wall and a rear wall in spaced relationship to each other to define an opening therebetween; a pair of shoulder supporting sections in spaced relation and extending in opposite directions from said center section; a connector means on said front wall for releasable locking engagement with a wire hanger after a portion of said wire hanger is received through said opening between said front wall and said rear wall and moved into engagement with said connector means; and a collar shaper means on said back wall for releasable engagement with the collar member on such garment when supported on said shoulder support.

5. The shoulder support for garments as in claim 2, 3 or 4 wherein said shoulder support comprises a unitary member constructed of resilient material such that the shoulder sections will assume a collapsed condition when subjected to compressive forces to occupy less space and on release will return to their normal size and shape when the compressive forces are removed.

6. The shoulder support for garments as in claim 2, 3 or 4 wherein said shoulder support is constructed from a plastic material having inherent mechanical strength and rigidity and predetermined thickness such that the shoulder sections will assume a collapsed condition when subjected to compressive forces to occupy less space and on release will return to their normal size and shape when the compressive forces are removed.

7. The shoulder support for garments as in claim 2, 3 or 4 wherein said shoulder support is constructed from a plastic material having inherent mechanical strength and rigidity and a gauge greater than about 0.005" such that the shoulder sections will assume a collapsed condition when subjected to compressive forces to occupy less space and on release will return to their normal size and shape when the compressive forces are removed.

8. The shoulder support for garments as in claim 2, 3 or 4 wherein said shoulder support is constructed from plastic materials selected from the group consisting of nylon, polyester, polypropylene and mixtures thereof.

9. The shoulder support for garments attachable to a wire hanger as in claim 2 or 4 wherein the connector means comprises an inwardly projecting planar member; said planar member having a length less than the width of the wire hanger opening in the center section; and sized slot means in the planar member disposed for releasable locking engagement with the wire hanger in assembled position with the shoulder support for the garments.

10. The shoulder support for garments as in claim 2 or 4, further comprising in combination a wire hanger for attachment to said shoulder support, said wire hanger including a hook section attached to a neck section and oppositely extending longitudinal sections connected to said neck section; and the neck section movable through the opening formed in the center section and into engagement with the connector means to releasably lock the wire hanger onto the shoulder support.

11. A shoulder support for garments as in claim 2, 3 or 4 having slot means in at least the front wall for hanging ties, belts and accessories.

12. A shoulder support for garments as in claim 2, 3 or 4 including at least one strengthener element in each of the respective pairs of shoulder support sections of the shoulder support.

13. A shoulder support for garments as in claim 2, 3 or 4 including at least one longitudinal groove in each of the respective pairs of shoulder support sections of the shoulder support.

14. A shoulder support for garments as in claim 2, 3 or 4 including at least one strengthening member in each of the respective pairs of shoulder sections of the shoulder support.

15. A shoulder support for garments as in claim 2, 3 or 4 including at least one longitudinally extending metal stiffening member in each of the respective pairs of shoulder sections of the shoulder support.

16. A shoulder support for garments attached to a wire hanger, said shoulder support comprising a center section having a front wall and a rear wall in spaced relationship to each other to define an opening therebetween, said front wall having a top edge; a pair of shoulder supporting sections in spaced relationship and extending in opposite directions from said center section; a connector attached to said top edge of said front wall and extending in overlying relation to said opening, and said connector having a slot for receiving a portion of said wire hanger.

17. The shoulder support for garments in claim 16, wherein said connector is arranged transverse to said front wall.

18. The shoulder support for garments in claim 16 wherein said connector includes a pair of spaced slots in collinear alignment separated by a support member.

19. The shoulder support for garments in claim 16, wherein said connector has an arcuate shape.

20. A shoulder support for garments attachable to a wire hanger having garment supporting side sections, said shoulder support comprising a center section having a front wall and a rear wall in spaced relation to each other to define an opening therebetween; a pair of shoulder supporting sections in spaced relationship connected to one end to the center section and extending in opposite directions from said center section; connector means on said front wall of said center section and disposed to overlie a portion of said opening; and said pair of shoulder supporting sections for operative engagement with the garment supporting side sections of the wire hanger to force a portion of the wire hanger into releasable locking engagement with the connector means when the wire hanger is assembled through the opening in the center section of the shoulder support.

21. A shoulder support for garments having collars attachable to a wire hanger having garment supporting side sections, said shoulder support comprising a center section having a front wall and a rear wall in spaced relation to each other to define an opening therebetween; a pair of shoulder supporting sections in spaced relations connected at one end to the center section and extending in opposite directions from said center section; connector means on said front wall of said center section and disposed to overlie a portion of said opening; said pair of shoulder supporting sections for operative engagement with the garment supporting side sections of the wire hanger to force a portion of the wire hanger into releasable locking engagement with the connector means when the wire hanger is assembled through the opening in the center section of the shoulder support, and a collar shaper means on said side back wall of the center section for releasable engagement with the collar member on the garment when the wire hanger is releasably assembled with the connector means.

22. A shoulder support for garments as in claim 20 or 21 wherein the shoulder support is a generally unitary member made of resilient material having inherent mechanical strength and rigidity and of a predetermined thickness to permit the general unitary member to be compressed during storage and stacking of the garment to occupy less space and on release to expand back to the original size when the compression is released.

23. A shoulder support for garments as in claim 20 or 21 wherein the shoulder support is a generally unitary member made of a plastic material having inherent mechanical strength and rigidity and of a predetermined thickness that can be compressed during storage and stacking of the garment to occupy less space and to expand back to the original size when the compression is released.

24. A shoulder support for garments as in claim 20 or 21 wherein the shoulder support is a generally unitary member made of a plastic material having inherent mechanical strength and rigidity and a gauge greater than 0.005" such that the shoulder sections will assume a collapsed condition when subject to compressive forces to occupy less space and expand back to the original size when the compressive forces are released.

25. A shoulder support for garments as in claim 20 or 21 wherein the shoulder support is a generally unitary member made of plastic materials from the group consisting of nylons, polyesters and polypropylene having inherent mechanical strength and rigidity and a predetermined thickness to permit the general unitary member to be releasably compressed during storage of the garment.

26. A shoulder support for garments as in claim 20 or 21 wherein the connector means on the front wall of the center section includes an inwardly projecting planar member, said planar member having a length less than the width of the wire hanger opening in the center section and disposed to overlie a portion of the opening; and at least one sized slot means in the planar member disposed for the releasable locking engagement with a portion of the wire hanger during assembly of the shoulder support to the wire hanger.

* * * * *

UNITED STATES PATENT AND TRADEMARK OFFICE

CERTIFICATE OF CORRECTION

PATENT NO. : 6,644,521 B1 
DATED : November 11, 2003
INVENTOR(S) : Irving Tiss and Burton J. Schwartz It is certified that error appears in the above-identified patent and that said Letters Patent is hereby corrected as shown below:

Column 1,
Line 42, “cardboard like” should read -- cardboard-like --.
Line 48, “halfconical” should read -- half-conical --.
Line 60, “plastic like” should read -- plastic-like --.

Column 3,
Line 5, delete comma after “having”

Column 4,
Line 29, “sold” should read -- solid --.

Column 5,
Line 59, delete comma after “its”.

Column 7,
Line 30, “33, see FIG. 3” should read -- 33 (see FIG. 3) --.

Column 8,
Lines 14, 26 and 35, after “section” insert -- such that under compressive forces, the shoulder support will be compressed from its original shape to occupy less space and on release of the compressive forces, the shoulder support will expand to substantially its original shape --.

Signed and Sealed this

Second Day of March, 2004

JON W. DUDAS
*Acting Director of the United States Patent and Trademark Office*